United States Patent [19]

Hoerner

[11] 4,024,658

[45] May 24, 1977

[54] THREE DIMENSIONAL CHARACTER

[76] Inventor: Eugen Hoerner, Neuer Weg 2, D-7101 Eberstadt (Baden-Wurttemberg), Germany

[22] Filed: Aug. 11, 1975

[21] Appl. No.: 603,257

[30] Foreign Application Priority Data

Aug. 12, 1974 Germany ..... 2438608

[52] U.S. Cl. ..... 40/130 D

[51] Int. Cl.[2] ..... G09F 13/00

[58] Field of Search ..... 40/130 D, 132 D, 132 R, 40/130

[56] References Cited

UNITED STATES PATENTS

| | | | |
|---|---|---|---|
| 1,724,243 | 8/1929 | Willey | 40/132 R |
| 1,789,667 | 1/1931 | Brackensy | 40/130 D |
| 2,141,955 | 12/1938 | Lang | 40/130 D |
| 2,923,080 | 2/1960 | Spangler | 40/130 D |
| 3,755,943 | 9/1973 | Cesarotti | 40/130 D |

FOREIGN PATENTS OR APPLICATIONS

| | | | |
|---|---|---|---|
| 1,187,036 | 9/1959 | France | 40/130 D |
| 1,107,314 | 3/1968 | United Kingdom | 40/130 D |

*Primary Examiner*—Louis G. Mancene
*Assistant Examiner*—Wenceslao J. Contreras
*Attorney, Agent, or Firm*—Robert E. Burns; Emmanuel J. Lobato; Bruce L. Adams

[57] ABSTRACT

A three dimensional character for a sign has a rear part in the form of a box with an open face closed by a cover. Edges of the open face comprise outwardly bent portions of L-shaped cross-section. One limb of each L lies parallel to the respective side wall of the rear part, while the other limb projects perpendicularly outwards, so that the side walls are reinforced and at the same time a mounting seat for the cover is formed.

8 Claims, 5 Drawing Figures

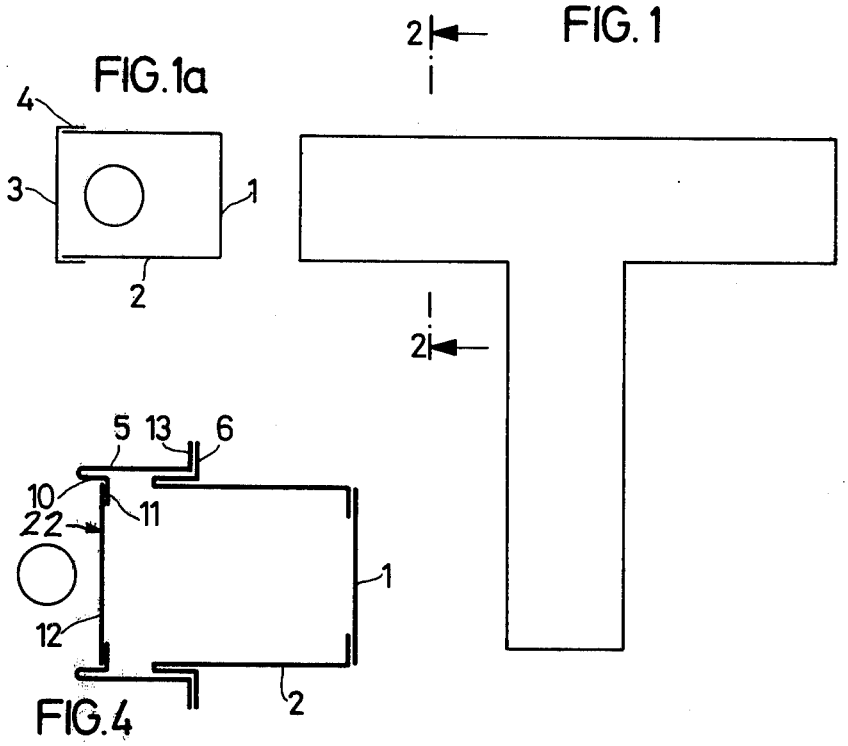
FIG. 1
2
2
FIG. 1a
4
3
1
2
5
13
6
10
11
22
1
12
2
FIG. 4
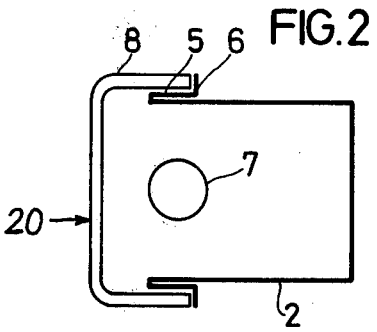
FIG. 2
8
5
6
7
20
2
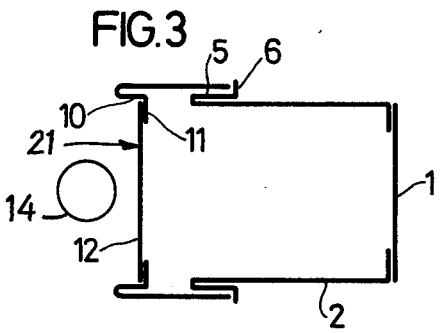
FIG. 3
5
6
10
21
11
14
12
1
2

THREE DIMENSIONAL CHARACTER

This invention relates to a three dimensional character of box-shaped cross-section, and can extend to a box-section signboard. Such characters and signboards are used in non-illuminated and illuminated advertising lettering and signs. Because of the box-shaped cross-section, the structure is of architecturally attractive appearance and good stability, with relatively low weight. Furthermore, electrical installation material and neon tubes may be fitted in the hollow space in the box or on an outer face of the box.

The box floor is usually of sheet metal and is fixed to a wall of a building or to an assembly bar. The box cover is either of translucent plastics or of sheet metal, and in this latter case can carry neon tubes on its outer face.

In a known embodiment, the casing of the box-shaped lower part is of simple metal sheet, as are the rims of the cover when this is of sheet metal. When not fitted together, the stability of the two parts of the character is relatively poor. As the cover is fitted only after assembly is finished, the characters, particularly if large, must either be made of large-thickness sheet metal or employ particular safety measures so that the lower and upper parts do not become distorted before fitting together.

According to the invention, there is provided a three dimensional character or a box-section signboard having a rear part in the form of a box with an open face and a cover for closing the open face, wherein edges of the open face of the rear part comprise outwardly bent portions of L-shaped cross-section, one limb of each L lying parallel to the respective side wall of the rear part and the other limb of each L projecting outwards perpendicular to said one limb, so that the side walls are reinforced and at the same time a mounting seat for the cover is formed.

Further advantageous characteristics of the invention are described in greater detail, by way of example, with reference to the embodiments shown in the drawing, with reference to the embodiments shown in the drawing, in which:

FIG. 1 is a front view of an example of the letter T in the form of a three dimensional character for a sign, FIG. 1*a* is a section on a line analogous to 2—2 of FIG. 1, through a conventional three dimensional character, FIG. 2 is a section on the line 2—2 of FIG. 1, through a first embodiment of a three dimensional character according to the invention, FIG. 3 is a section on a line analogous to 2—2 of FIG. 1, through a second embodiment of a three dimensional character according to the invention, and FIG. 4 is a section on a line analogous to 2—2 of FIG. 1, through a third embodiment of a three dimensional character according to the invention.

FIG. 1 is a front view of the letter T in the form of a three dimensional character for a sign. The letter T is given as an example; the same construction applies to any character. The conventional cross-section of such a three dimensional character is shown in FIG. 1*a* for the better understanding of the invention. In this conventional construction, a casing 2 is soldered or welded to a rear plate 1 of the back part. A rim 4 is fixed in a similar manner to the front plate 3 of the outer part. The cross-sections of three dimensional characters according to the invention are shown in FIGS. 2, 3 and 4, the character in FIG. 2 being provided with a plastic cover 20 and that in FIGS. 3 and 4 with sheet metal covers 21, 22 respectively. The casing 2 of the back part has at its outer edge a portion of L cross-section 5, 6 bent back against the casing 2. By this means the box is given high stability of shape even with a small sheet metal thickness. At the same time, the bent portion 6 serves as a seat for the cover, so that the position of the cover 20 after assembly is exactly fixed, even when large covers are being used. Particularly in the case of plastic covers, it is often desirble for neon tubes 7 situated in the interior of the letter to partly illuminate the side surfaces of the outer part. To this end the plastic cover comprises a relatively high edge 8.

If both the cover 21 and the back part are of sheet metal as shown in FIG. 3, the cover 21 may be provided with an L-shaped bend 10, 11. While the L-shaped bend on the back part is directed outwards, in the case of the cover it is directed inwards. The part of the bent portion 10 lying parallel to the casing gives the upper part an attractive rounded frontal tip. If the bent portion is sufficiently long, sideward radiation from neon tubes, mounted as shown at 14 in FIG. 3, is prevented. The front plate 12 of the cover 21 is fixed to the other limb 11 of the bent portion by spot-welding. In addition to its attractive appearance, this embodiment has the great advantage that the front plate 12 of the cover and floor plate 1 of the rear part are identical in dimensions and may therefore be punched out with the same tool.

If the rim of the cover 22 in FIG. 4 is provided with a further outwardly bent portion 13 perpendicular to the rim, then increased stability is obtained, particularly if this bent portion is joined to the bent portion 6 of the casing after assembly, by welding, soldering or the like.

I claim:

1. A three dimensional sign character comprising a box formed in the shape of the desired character, said box having a closed back and an open front, and a cover closing the open front of the box, said box having a back and a sheet metal side wall projecting forwardly from the back, a forward marginal portion of said side wall being folded back on itself to provide a marginal portion parallel to the side wall and an edge portion of said folded back marginal portion being bent at right angles to the side wall to provide an angular flange perpendicular to the side wall and set back from the open front of the box, said cover fitting over and closing the front of said box and having a face portion parallel to the back of the box and a peripheral rim portion which is perpendicular to said face portion and extends toward the back of the box, said rim portion of the cover laterally engaging said folded back marginal portion of the side wall of the box and seating on said angular flange, said flange performing the dual function of stiffening and reinforcing the open front of the box and of providing an abutment to position said cover relative to said box.

2. A three dimensional sign character according to claim 1, in which said folded back marginal portion of said side wall is on the outside of said side wall and said angular flange projects outwardly at right angles to said side wall.

3. A three dimensional sign character according to claim 2, in which a tubular light source is disposed in said box and said cover only is of translucent plastic material, said rim portion of said translucent plastic cover fitting over said folded back portion of said box and seating on said angular flange.

4. A three dimensional sign character according to claim 5, in which said rim portion of said translucent plastic cover is of greater depth than said folded back marginal portion of the side wall of the box forwardly of said angular flange, whereby a portion of said rim is illuminated by said tubular light source.

5. A three dimensional sign character according to claim 2, in which said rim portion of said cover comprises a peripheral portion extending forwardly from said face portion and then folded back on itself to provide a rearwardly extending portion which fits over said folded back portion of said box and seats on said angular flange.

6. A three dimensional sign character according to claim 5, in which a tubular light source is mounted in front of the face portion of said cover in position such that lateral light rays from said light source are partially blocked by said forwardly extending portion of said rim portion.

7. A three dimensional sign character according to claim 5, in which a rear edge portion of said rearwardly extending portion of said rim of the cover is bent outwardly at right angles to provide an angular flange which seats on said angular flange of the box.

8. A three dimensional sign character according to claim 1, in which the back of said box and the face portion of said cover have identical dimensions and are hence interchangeable.

* * * * *